US008433234B2

(12) United States Patent
Kim et al.

(10) Patent No.: US 8,433,234 B2
(45) Date of Patent: Apr. 30, 2013

(54) IMAGE FORMING APPARATUS AND METHOD THEREOF

(75) Inventors: Min Jae Kim, Ulsan (KR); Jin Min Chung, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 927 days.

(21) Appl. No.: 12/184,396

(22) Filed: Aug. 1, 2008

(65) Prior Publication Data

US 2009/0067909 A1 Mar. 12, 2009

(30) Foreign Application Priority Data

Sep. 6, 2007 (KR) ..... 10-2007-0090291

(51) Int. Cl.
*G03G 15/00* (2006.01)

(52) U.S. Cl.
USPC ..... 399/405; 399/397; 399/402; 399/407; 271/301; 271/302; 271/303; 271/304; 271/306

(58) Field of Classification Search ..... 399/397, 399/402, 405, 407; 271/301, 302, 303, 304, 271/306
See application file for complete search history.

(56) References Cited

U.S. PATENT DOCUMENTS

| | | | | |
|---|---|---|---|---|
| 4,806,979 | A * | 2/1989 | Tokoro et al. | 399/401 |
| 2004/0183246 | A1 * | 9/2004 | Jung et al. | 270/37 |
| 2006/0220309 | A1 * | 10/2006 | Igarashi | 271/303 |
| 2006/0251453 | A1 * | 11/2006 | Miyake | 399/401 |

FOREIGN PATENT DOCUMENTS

JP 05-39131 2/1993

* cited by examiner

*Primary Examiner* — Judy Nguyen
*Assistant Examiner* — Andy Pham
(74) *Attorney, Agent, or Firm* — Stanzione & Kim, LLP

(57) ABSTRACT

An image forming apparatus includes a housing formed with a discharge port, a printing device mounted in the housing, a discharge reverse unit to reversely move paper passing through the printing device, and a discharge unit to convey the paper, moving reversely by the discharge reverse unit, to the discharge port. The discharge reverse unit includes a guide member to guide the paper passing through the printing device to the discharge unit, and a lifting part to lift the guide member up and down. The image forming apparatus can prevent jams in a paper discharge device even when increasing a discharge speed in a discharge path, through which a printed printing medium is discharged in such a state that a printed surface of the printing medium is directed in a down direction.

20 Claims, 9 Drawing Sheets

IMAGE FORMING APPARATUS AND METHOD THEREOF

CROSS-REFERENCE TO RELATED APPLICATIONS

This application claims priority under 35 U.S.C. §119(a) from Korean Patent Application No. 2007-0090291, filed on Sep. 6, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having an improved printing medium feeding path.

2. Description of the Related Art

A conventional image forming apparatus is an apparatus that prints an image on a printing medium, e.g., paper, according to an input image signal. As one type of the image forming apparatus, an electrophotographic image forming apparatus is configured such that a light beam is scanned to a photosensitive member charged to a predetermined electric potential to form an electrostatic latent image on an outer peripheral surface of the photosensitive member, the electrostatic latent image is developed into a toner image by adhering a toner to the electrostatic latent image, and the toner image is transferred and fused onto paper. The printed paper is discharged to the outside of a housing of the image forming apparatus by discharge rollers.

The conventional image forming apparatus includes a printing medium feeding unit to supply a printing medium, a printing unit to print an image of letters or pictures on the printing medium supplied from the printing medium feeding unit, and a printing medium discharge unit to discharge the printed printing medium.

In the conventional image forming apparatus as constituted above, a shape of a printing medium feeding path is determined dependent within structures of the printing medium feeding unit, the printing unit and the printing medium discharge unit and arrangement of components of the respective units. The printing medium feeding path of the image forming apparatus is generally shaped in an L-type, a C-type, an S-type, or the like. The image forming apparatus can be classified as a front-in-front-out (FIFO) type or a front-in-side-out (FISO) type according to supplying and discharging directions of the printing medium.

However, the above conventional image forming apparatus is configured such that the printed printing medium is discharged to a printing medium discharge tray while a printed surface of the printing medium is directed upward. Therefore, when a plurality of sheets of printing media are printed, the printed pages are arranged in a reverse order, which inconveniences a user having to manually arrange the printed pages in a correct order.

To solve such inconveniences, the discharge unit includes a first discharge roller which conveys the printed paper rearward from the printing unit provided in a front portion of the image forming apparatus, a reverse roller which reverses the moving direction of the paper, which is conveyed by the first discharge roller, from the rearward to the forward, and a second discharger roller which discharges the printed paper, whose moving direction has been reversed, to the outside.

Thereby, the printed paper is discharged while the printed surface of the paper is directed in a down direction.

Because the printing medium is picked up rearward from the printing medium feeding cassette and conveyed forward to be printed, and then the printed printing medium is discharged to the discharge tray provided at the front portion of the image forming apparatus, the above-described conventional FIFO type image forming apparatus has an advantage of easy feeding and retrieving of the printing medium.

However, in the above-described conventional image forming apparatus, the reverse roller should be rotated sequentially in a forward direction and a reverse direction in order to perfectly discharge a sheet of printed paper to the outside. Thus, in a case where a plurality sheets of printed paper are intended to be discharged successively, at least until the preceding sheet of paper to be discharged passes away from the reverse roller, the following sheet of paper to be discharged should be kept in a standby state. If increasing a discharge speed, there is a problem such that paper jams occur in the discharge unit.

Also, because the conventional image forming apparatus is provided with a motor to drive the reverse roller, in addition to a motor to drive the first and second discharge rollers, manufacturing cost is increased, and the discharge unit has a large bulky size.

SUMMARY OF THE INVENTION

The present general inventive concept provides an image forming apparatus capable of preventing jams in a paper discharge device even when increasing a discharge speed in a discharge path, through which a printed printing medium is discharged in such a state that a printed surface of the printing medium is directed in a downward direction.

The present general inventive concept also provides an image forming apparatus capable of driving a paper discharge device by use of a single motor.

The present general inventive concept also provides an image forming apparatus having a compact overall size.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus comprising: a housing formed with a discharge port, a printing device mounted in the housing, a discharge reverse unit to reversely move paper passing through the printing device, and a discharge unit to convey the paper, moving reversely by the discharge reverse unit, to the discharge port. The discharge reverse unit may include a guide member to guide the paper passing through the printing device to the discharge unit, and a lifting part to lift the guide member up and down.

The discharge reverse unit may include a paper fixing part to prevent the paper on the guide member from moving away from the guide member.

The lifting part may include a driving motor, a gear part connected to the driving motor, and a cam part to lift the guide member up and down according to rotation of the gear part.

The discharge unit may include a plurality of discharge rollers. The discharge rollers may be driven by the driving motor.

The gear part may include a first gear to transmit a driving force of the driving motor, and a second gear receiving a rotational force of the first gear. The first gear may be kept in an idling state in a predetermined region of the second gear. The cam part may be interlockingly rotated with rotation of the second gear.

The image forming apparatus may further include a sensor provided in a downstream position from the printing unit to sense a moving position of the paper.

The discharge reverse unit may further include an intermittence unit to intermit rotation of the second gear.

The intermittence unit may include a locking member to intermit rotation of the second gear, and an actuator to drive the locking member.

The discharge unit may include a plurality of discharge rollers, and the guide member may further include a guide roller to convey the paper. When the guide member is lifted up, the guide roller may come into contact with any one of the discharge rollers to move the paper toward the discharge port.

The guide member may further include a roller part corresponding to the cam part to smoothly lift the guide member up and down.

The paper fixing part may press the paper to prevent the paper on the guide member from moving away from the guide member.

The image forming apparatus may further include a paper receiving part to receive a front end of the paper positioned in the discharge reverse unit.

The paper receiving part may change the moving direction of the paper to a down direction.

The foregoing and/or other aspects and utilities of the present general inventive concept may also be achieved by providing an image forming apparatus comprising a housing formed with a discharge port; a printing device mounted in the housing, a discharge reverse unit to reversely move paper, which moves backward in the housing after passing through the printing device, forward in the housing, a discharge unit to convey the paper, moving reversely by the discharge reverse unit, to the discharge port, and a paper fixing part to prevent the paper in the discharge reverse unit from moving backward in the housing away from the discharge reverse unit.

The discharge reverse unit may include a guide member to guide the paper passing through the printing device to the discharge unit, and a lifting part to lift the guide member up and down. The lifting part may include a driving motor, a gear part connected to the driving motor, and a cam part to lift the guide member up and down according to rotation of the gear part.

The paper fixing part may press the paper to prevent the paper on the guide member from moving away from the guide member.

The foregoing and/or other aspects and utilities of the present general inventive concept may also be achieved by providing an image forming apparatus, including a housing, a printing device to form an image on a printing medium, a conveying unit to convey the printing medium with the image and having a roller to rotate in a direction, a discharge reverse unit to receive the printing medium from a first portion of the roller of the conveying unit, and to direct the printing medium toward a second portion of the roller, and a discharge unit to discharge the printing medium with the second portion of the roller.

The discharge reverse unit may include a shaft and a guide member extended from the shaft toward the roller.

The guide member may have a first portion coupled to the shaft and a second portion to move between the first portion of the roller and the second portion of the roller.

A first path may be formed with respect to the first portion, a second path may be formed with respect to the second portion, and the first path and the second path may be formed to be opposite with respect to a line connecting the shaft and a center of the roller.

The discharge reverse unit may include a cam part to selectively rotate according to a moving direction of the printing medium, such that the cam part controls the movement of the guide roller between the first portion of the roller and the second portion of the roller.

The housing may include a discharge port located at a front portion thereof.

The image forming apparatus may further include a discharge tray to catch the printing medium after being discharged through the discharge port.

The image forming apparatus may further include a paper receiving part to receive a front end of the printing medium in an opening thereof.

The image forming apparatus may further include a paper fixing part to prevent the printing medium from falling into the paper receiving part.

The paper fixing part may include a fixing member with a first end rotatably mounted in the housing and a second end to contact a surface of the discharge reverse unit, and an elastic member to elastically bias the fixing member to press a surface of the printing medium onto the discharge reverse unit.

The foregoing and/or other aspects and utilities of the present general inventive concept may also be achieved by providing an image forming apparatus, including a housing including a discharge port located at a front portion thereof, a printing device mounted at the front portion of the housing to form an image onto a printing medium, a conveying roller to receive the printing medium from the printing device, a paper receiving part to receive a front end of the printing medium in an opening thereof after passing through a first portion of the conveying roller, and a discharge reverse unit to reverse a movement of the printing medium toward the discharge port to discharge the printing medium by passing the printing medium through a second portion of the conveying roller, the discharge reverse unit including a cam part to selectively rotate according to a moving direction of the printing medium, and a guide member to move up and down according to the rotation of the cam part.

The cam part may rotate when the printing medium moves toward the front portion of the image forming apparatus.

The discharge reverse unit may further include a plurality of gears to control a rotation of the cam part, and a locking member to selectively allow one of the plurality of gears to move, such that the guide member moves up when the locking member allows the one of the plurality of gears to move.

The foregoing and/or other aspects and utilities of the present general inventive concept may also be achieved by providing a method of moving a printing medium through a housing of an image forming apparatus, the method including passing the printing medium through a printing device at a front portion of the image forming apparatus to print an image on a first side thereof, moving the printing medium toward a back portion of the housing across a discharge reverse unit, such that a paper fixing part prevents the printing medium from moving away from the discharge reverse unit, and reversing the movement of the printing medium to discharge the printing medium out the front portion of the image forming apparatus.

The method may further include guiding the printing medium through the printing device to the discharge unit using a guide member, and moving the guide member up and down according to a direction in which the printing medium is traveling.

The guide member may be moved up when the printing medium moves toward the front portion of the image forming apparatus, and the guide member may be moved down when the printing medium moves toward the back portion of the image forming apparatus.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
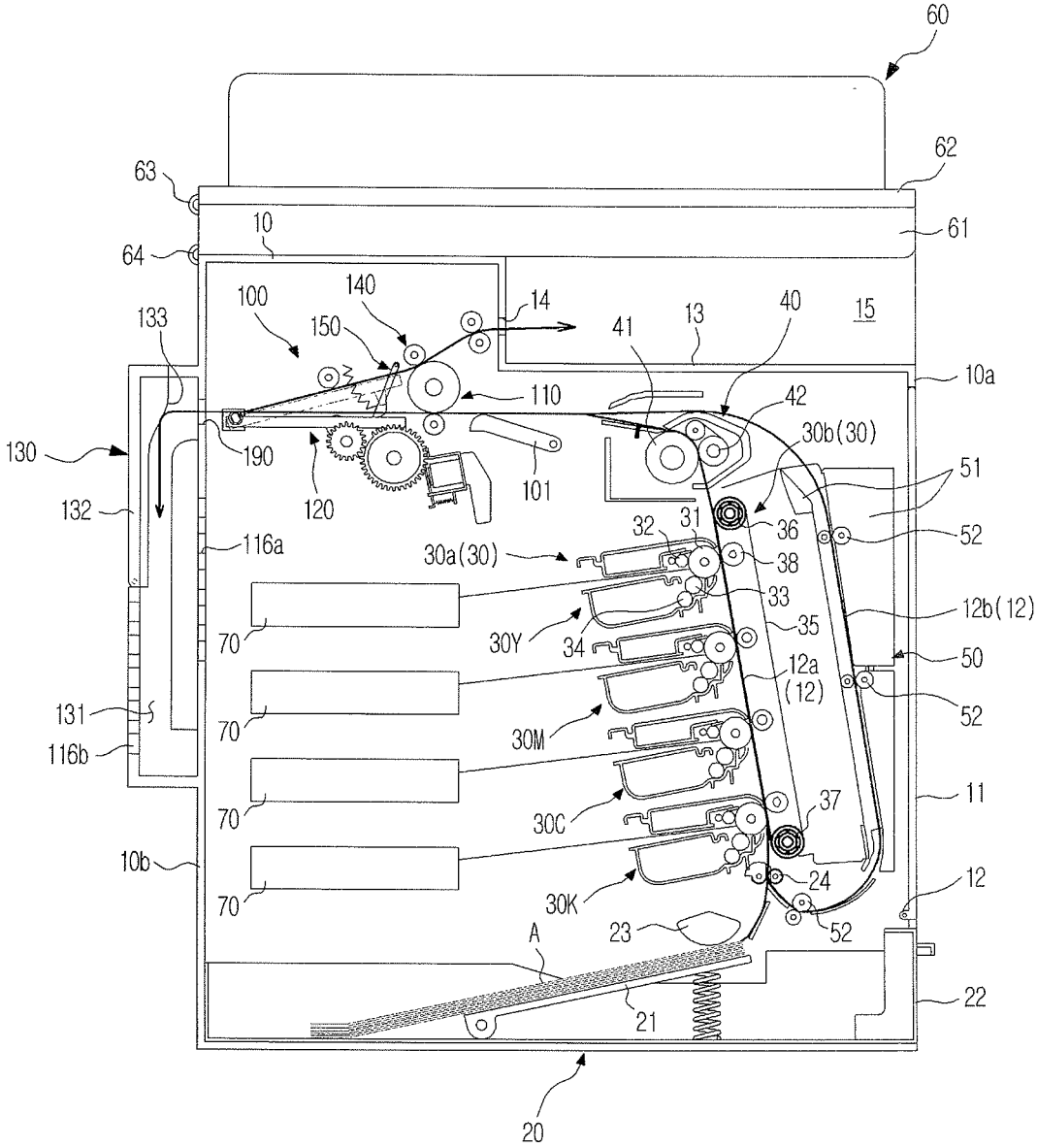
FIG. 1 is a side-sectional view schematically illustrating an image forming apparatus according to an exemplary embodiment of the present general inventive concept.

Reference will now be made in detail to embodiments of the present general inventive concept, examples of which are illustrated in the accompanying drawings, wherein like reference numerals refer to like elements throughout. The embodiments are described below to explain the present general inventive concept by referring to the figures.

Figure 2:
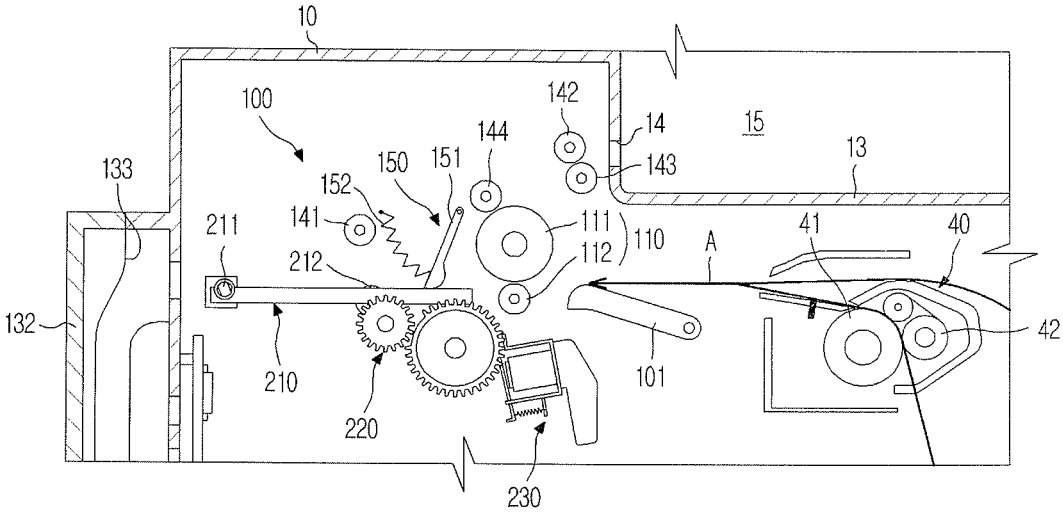
FIG. 2 is a view illustrating a portion of the image forming apparatus of FIG. 1.

FIG. 1 is a side-sectional view illustrating a constitution of an image forming apparatus according to an embodiment of the present general inventive concept, and FIG. 2 is a view illustrating a portion of the image forming apparatus depicted in FIG. 1.

As illustrated in FIG. 1, the image forming apparatus according to an embodiment of the present general inventive concept includes a housing 10 to form an exterior appearance and support components mounted thereinside, a paper feeding device 20 to supply a printing medium, e.g., paper A, a printing device 30 to print an image on the paper through a developing unit 30*a* and a transfer unit 30*b*, a fusing device 40 to fuse the image printed by the printing device 30 to the paper, a duplex printing device 50 to print an image on both surfaces of the paper, a scanning device 60 provided above the housing 10 to scan a document, and a paper discharge device 100 to discharge the paper to the outside through a discharge port 14 formed at the front portion of the housing 10.

A front cover 11 is mounted to the front portion of the housing 10 to open and close a front surface 10*a* of the housing 10. The front cover 11 is provided with a hinge part 12 at a lower end so as to rotate on the hinge part 12. A discharge tray 13 is provided on an upper portion of the housing 10, onto which the printed paper is discharged and stacked. The discharge port 14 is provided at the rear of the discharge tray 13, through which the printed paper is discharged out of the housing 10 and onto the discharge tray 13.

A paper moving path 12, through which the paper moves, is defined inside the housing 10. The paper moving path 12 includes a printing path 12*a*, in which the printing operation is conducted while the paper passes by the developing unit 30*a* and the transfer unit 30*b*, and a duplex printing circulation path 12*b*, through which the one-side printed paper circulates to an upstream position of the printing device 30 to print an image also on the other side of the paper.

The paper feeding device 20 includes a feeding cassette 22 having a feeding tray 21, on which the printing medium, i.e., the paper A, is loaded, a pickup roller 23 to pick up the paper A loaded on the feeding tray 21 sheet by sheet, and a conveying roller 24 to convey the picked-up paper A toward the printing device 30. The feeding cassette 22 is removably mounted in a lower portion of the housing 10.

The developing unit 30*a* of the printing device 30 includes four developing cartridges 30Y, 30M, 30C and 30K, in which toners of different colors, e.g., yellow (Y), magenta (M), cyan (C) and black (K), are respectively contained. The developing cartridges 30Y, 30M, 30C and 30K are respectively provided with photosensitive bodies 31, on surfaces of which electrostatic latent images are formed by a plurality of exposure units 70. The exposure units 70 irradiate light corresponding to image information of yellow, magenta, cyan and black to the photosensitive bodies 31 of the respective developing cartridges according to a print signal.

Each of the developing cartridges 30Y, 30M, 30C and 30K includes a charge roller 32 to charge each of the photosensitive bodies 31 to a predetermined electric potential, a development roller 33 to develop the electrostatic latent image formed on each of the photosensitive bodies 31 into a toner image, and a supply roller 34 to supply the toner to the development roller 33.

The transfer unit 30*b* of the printing device 30 transfers the toner image developed on the photosensitive bodies 31 onto the paper A. The transfer unit 30*b* includes a transfer belt 35 which circulates while being in contact with the photosensitive bodies 31, a driving roller 36 to drive the transfer belt 35, a tension roller 37 to maintain a constant tensile force of the transfer belt 35, and four transfer rollers 38 to transfer the toner images developed on the respective photosensitive bodies 31 onto the paper A.

The fusing device 40 applies heat and pressure to the image transferred onto the paper A so as to fuse the image to the paper A. The fusing device 40 includes a heating roller 41 having a heat source to apply heat to the toner image-transferred paper A, and a press roller 42 mounted while opposing the heating roller 41 to maintain a constant fusing pressure with the heating roller 41.

The duplex printing device 50 conveys the one-side printed paper A to the upstream position of the printing device 30 so that the other side of the paper A may also be printed thereupon. The duplex printing device 50 includes a guide frame 51 which forms the duplex printing circulation path 12*b*, and a series of duplex printing conveying rollers 52 mounted in the duplex printing circulation path 12*b* to convey the paper A.

The scanning device 60 is mounted above the housing 10. The scanning device 60 includes a main body 61, in which electronic components including an image sensor (not illustrated) are mounted, and an upper cover 62 which covers an upper surface of the main body 61. The upper cover 62 is coupled to the main body 61 by a first hinge part 63, and rotates on the first hinge part 63 to open and close the upper surface of the main body 61.

An extraction space 15 is formed between the main body 61 of the scanning device 60 and the discharge tray 13 provided on the upper portion of the housing 10. A user can extract the printed paper A, which is stacked on the discharge tray 13, through the extraction space 15. Since the scanning device 60 is rotatably coupled to the housing 10 by a second hinge part 64, if the user rotates the scanning device 60 backward on the second hinge part 64, the user can more easily extract the paper from the discharge tray 13.

The printing device 30, the fusing device 40, the printing path 12*a* and the duplex printing circulation path 12*b* are disposed near the front surface 10*a* of the housing 10. The front surface 10*a* of the housing 10 can be opened so that the user can get access to the printing device 30 and the fusing device 40 or the paper moving paths 12*a* and 12*b*. Thus, when a user desires to replace expendable components (e.g., toner, rollers, etc) of the printing device 30 or the fusing device 40, or remove paper jammed in the paper moving paths 12*a* and 12*b*, the user can carry out the replacing or removing operations at a front portion of the image forming apparatus. Accordingly, convenience of use is increased. Moreover, an additional space to perform the replacing or paper-jam-removing operations is not required, and thus the user can more efficiently use the space around the image forming apparatus.

When the printing device 30, the fusing device 40 and the paper moving paths 12*a* and 12*b* are disposed near the front surface 10*a* of the housing 10 as described above, the paper A passing through the fusing device 40 moves toward a rear surface 10*b* of the housing 10. Accordingly, the paper discharge device 100 reverses the moving direction of the paper, which moves toward the rear surface 10*b* of the housing 10, and then discharges the paper to the front of the housing 10.

As illustrated in FIGS. 1 and 2, the paper discharge device 100 includes a conveying unit 110 to convey the paper A passing through the fusing device 40 toward the rear surface 10*b* of the housing 10, a discharge reverse unit 120 to reversely convey the paper A conveyed by the conveying unit 110, a paper receiving part 130 provided at the rear of the discharge reverse unit 120 to receive the front end portion of the paper A moving on the discharge reverse unit 120, through an opening 190, and a discharge unit 140 provided between the discharge reverse unit 120 and the discharge port 14 to discharge the paper A conveyed by the discharge reverse unit 120 to the discharge tray 13 provided on the upper portion of the housing 10.

During the paper discharge process, the conveying unit 110 conveys the paper passing through the fusing device 40 to the discharge reverse unit 120. The conveying unit 110 includes a conveying roller 111 which is rotated by receiving power from a driving source (not illustrated), and a conveying idle roller 112 which is rotated in contact with the conveying roller 111.

A sensor 101 is mounted between the fusing device 40 and the conveying unit 110, to sense the position of the conveyed paper A.

The discharge reverse unit 120 reverses the paper A, which moves backward after passing through the fusing device 40, to the front. The discharge reverse unit 120 is mounted in the downstream position from the conveying unit 110 in the paper moving path 12.

Figure 3:
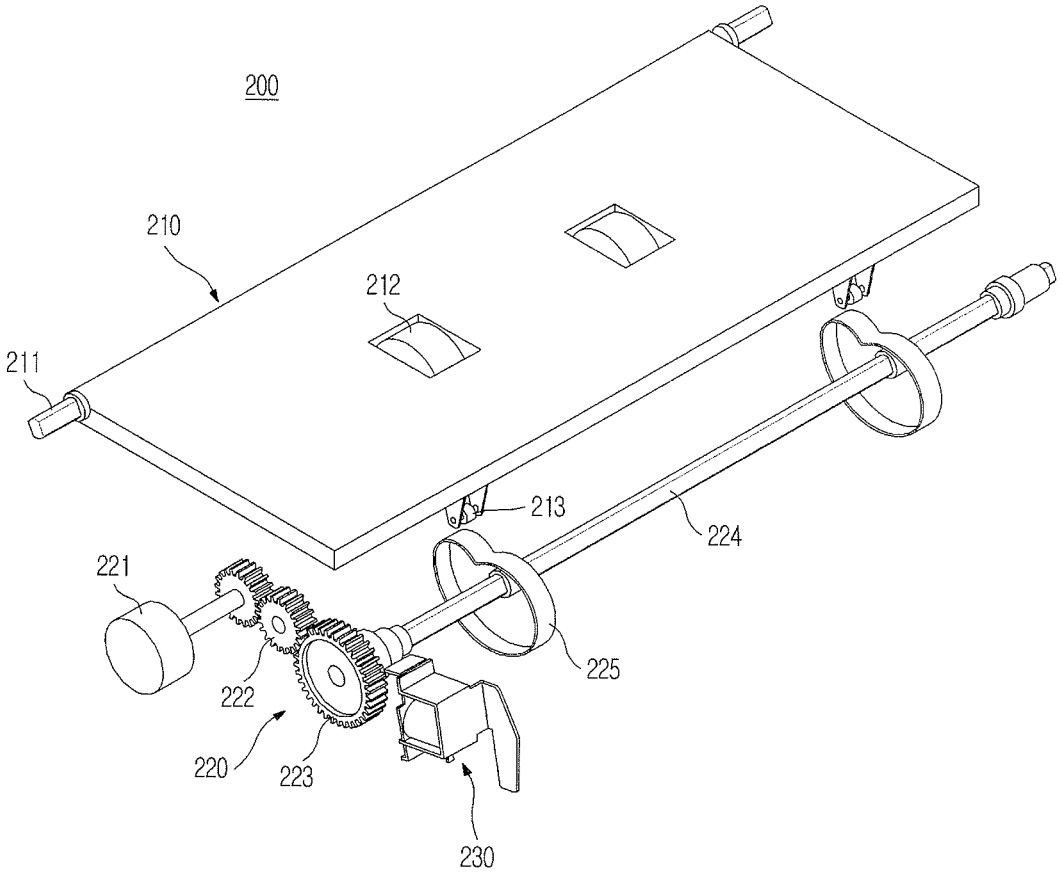
FIG. 3 is an exploded perspective view of a discharge reverse unit of an image forming apparatus according to an exemplary embodiment of the present general inventive concept.

FIG. 3 is an exploded perspective view of the discharge reverse unit of an image forming apparatus.

As illustrated in FIG. 3, the discharge reverse unit 120 includes a guide member 210 to guide the paper A passing through the fusing device 40, a lifting part 220 to lift a first end portion of the guide member 210 up and down by rotating the guide member 210, an intermittence unit 230 to intermit the operation of the lifting part 220, and a paper fixing part 150 (refer to FIG. 1) to prevent the paper A on the guide member 210 from falling into the paper receiving part 130. The paper receiving part 130 may include an inner grate 116*a* which is openable to remove a potentially jammed paper A from the receiving part 130 via an inner portion of the image forming apparatus. The paper receiving part 130 may also include an outer grate 116*b* which is openable to remove a potentially jammed paper A from the receiving part 130 via the outside of the image forming apparatus.

The guide member 210 is formed with a shaft part 211 at a second end portion thereof so that the guide member 210 can be rotatably mounted in the housing 10. Guide rollers 212 are mounted to the guide member 210, which come into contact with a first discharge roller 141 (which will be described later) when the guide member 210 is lifted up, to move the paper A on the guide member 210 to the discharge port 14.

Roller parts 213 are mounted to the first end portion of the guide member 210, which are in contact with cam parts 225 of the lifting part 220 (which will be described later), so as to smoothly lift the guide member 210 up and down according to the rotation of the cam parts 225.

The lifting part 220 includes a driving motor 221, gear parts 222 and 223 connected with the driving motor 221, a rotating shaft part 224 coupled to a second gear 223 of the gear parts 222 and 223 to be rotated according to the rotation of the second gear 223, and the cam parts 225 fixed to the rotating shaft part 224 to be interlockingly rotated with the second gear 223.

A plurality of gears may be connected between the driving motor 221 and a first gear 222 of the gear parts 222 and 223. Although not illustrated in the drawings, a plurality of gears may be connected between the driving motor 221 and the discharge unit 140 so that the discharge unit 140 can be driven by the driving motor 221. Since methods of driving a plurality of discharge rollers (including the discharge roller 141 and a second discharge roller 142) of the discharge unit 140 by use of the single driving motor 221 is already well known, explanation thereof will be omitted.

By connecting the gears to the driving motor 221, which drives the plurality of discharge rollers, to drive the discharge reverse unit 120, the entire paper discharge device 100 can be driven by use of the single driving motor 221.

The second gear 223 is provided with an idling region 223*a* (refer to FIG. 7), in which gear teeth are not formed, on an outer peripheral surface thereof. Because the first and second gears 222 and 223 are not tooth-engaged with each other in the idling region 223*a* even when the first gear 222 rotates, the second gear 223 does not rotate in the idling region 223*a*.

The cam parts 225 fixed to the rotating shaft part 224 are rotated according to the rotation of the second gear 223. Since the cam parts 225 are eccentrically fixed to the rotating shaft part 224, when the cam parts 225 rotate, the roller parts 213 of the guide member 210, which are kept in contact with the cam parts 225, roll on the outer surfaces of the cam parts 225, thereby lifting the guide member 210 up and down.

Figure 7:
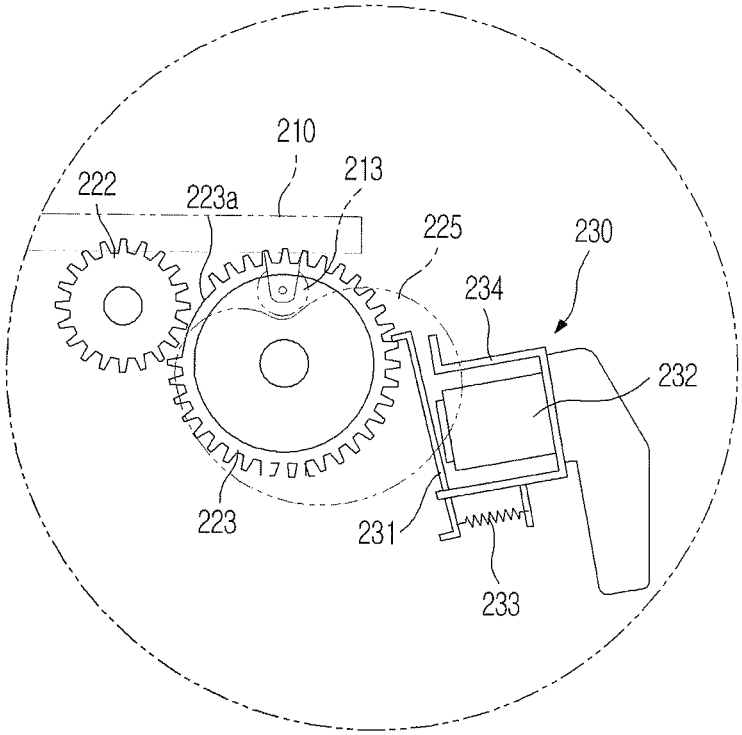
FIGS. 7 and 8 are enlarged views illustrating operations of a discharge reverse unit of an image forming apparatus according to an exemplary embodiment of the present general inventive concept.
Figure 8:
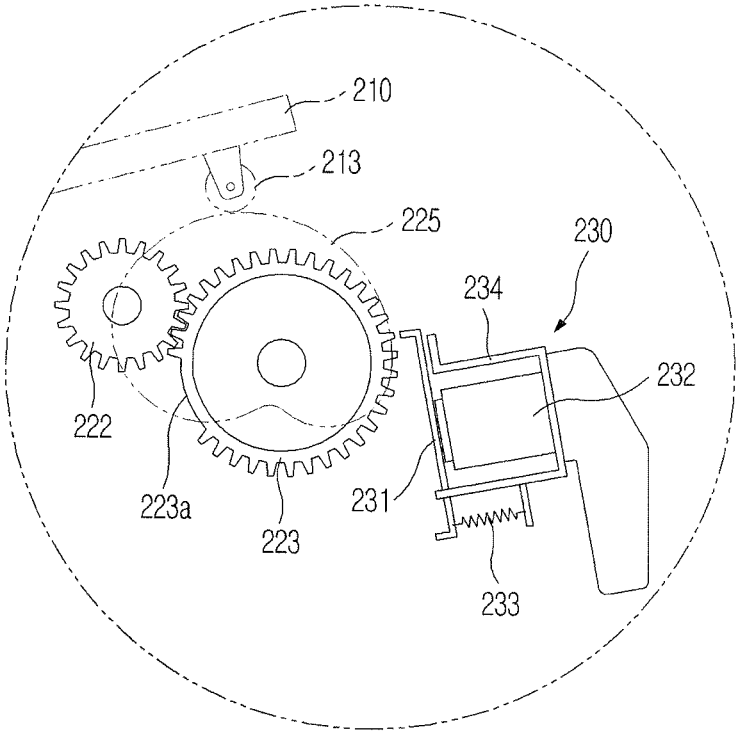

As illustrated in FIGS. 7 and 8, the intermittence unit 230 includes a bracket 234, an actuator 232 supported by the bracket 234, and a locking member 231 provided movably by the actuator 232 between a locking position, in which a first end of the locking member 231 interferes with any one of the teeth of the second gear 223, and a releasing position, in which the first end of the locking member 231 is pulled away from the teeth of the second gear 223. An elastic member 233 is connected with a second end of the locking member 231 to apply an elastic force to the second end of the locking member 231 so that the first end of the locking member 231 moves to the locking position. When electric current is applied to the actuator 232, the locking member 231 is pulled toward the actuator 232 by a magnetic force, and the locking member 231 is pulled away from the teeth of the second gear 223. When the electric current is not applied to the actuator 232, the locking member 231 moves toward the teeth of the second gear 223 by the elastic force of the elastic member 233, and the first end of the locking member 231 interferes with the teeth of the second gear 223. Thereby, the rotation of the second gear 223 is restrained.

Accordingly, when the locking member 231 is positioned in the locking position, the first gear 222 idles in contact with the idling region 223*a* of the second gear 223, and the rotational force of the first gear 222 is not transmitted to the second gear 223.

When the locking state by the locking member 231 is released, the second gear 223 initially rotates by the frictional force by the rotation of the first gear 222, and then the first gear 222 and the second gear 223 are tooth-engaged with each other. Thereby, the rotational force of the first gear 222 is transmitted to the second gear 223, and thus the second gear 223 is rotated.

When the second gear 223 is rotated once and the first gear 222 comes into contact with the idling region 223*a*, if the actuator 232 is turned off, the locking member 231 moves to the locking position, and thus the rotation of the second gear 223 is restrained.

During the rotation of the second gear 223, the cam parts 225 are interlockingly rotated once with the second gear 223, and accordingly the guide member 210 is lifted up and down by the rotation of the cam parts 225.

As illustrated in FIG. 2, the paper fixing part 150 is included to prevent the paper A on the guide member 210 from falling into the paper receiving part 130 by pressing the surface of the paper A onto the guide member 210. More specifically, the paper fixing part 150 includes a fixing member 151 which has a first end rotatably mounted in the housing 10 and a second end contacting the upper surface of the guide member 210, and an elastic member 152 which elastically biases the fixing member 151 to press the surface of the paper A onto the guide member 210.

The paper A passing through the guide member 210 moves to the rear of the housing 10 until the rear end of the paper A passes entirely through the conveying roller 111. At this time, the front end of the paper A has passed beyond the guide member 210, which may cause the paper A to fall from the guide member 210 by its own weight into the paper receiving part 130.

In order to prevent the falling of the paper A, the fixing member 151 of the paper fixing part 150 presses the paper A to the upper surface of the guide member 210.

The paper receiving part 130, as illustrated in FIG. 1, is mounted to an outer rear portion of the housing 10, and forms a receiving space 131 to temporarily receive the paper A. A space, in which the front end of the paper passing through the guide member 210 can move until the rear end of the paper A passes entirely through the conveying roller 111, is required. The paper receiving part 130 provides the space allowing such movement of the front end of the paper A. The paper receiving part 130 includes a cover 132, which is formed with a guide rib 133 to guide the front end of the paper downward and allows the outer grate 116*b* of the paper receiving part 130 to open and/or close to expose the receiving space 131 to the outside.

The discharge unit 140, as illustrated in FIG. 2, is provided between the discharge reverse unit 120 and the discharge port 14, and discharges the paper A, which moves reversely by the discharge reverse unit 120, through the discharge port 14. The discharge unit 140 includes the first discharge roller 141 which is paired with the guide roller 212 to move the paper toward the discharge port 14 when the guide member 210 is lifted, a first discharge idle roller 144 which is rotated in contact with the conveying roller 111 of the conveying unit 110, and the second discharge roller 142 and a second discharge idle roller 143 which are provided at the upstream position of the discharge port 14.

Hereinafter, an operation of the image forming apparatus according to an embodiment of the present general inventive concept will be described with reference to the accompanying drawings.

First, the printing operation and the paper discharging operation of the image forming apparatus according to an embodiment of the present general inventive concept will be explained. As illustrated in FIGS. 1 and 2, if a printing command is input, the exposure units 70 irradiate light corresponding to image information of yellow, magenta, cyan and black to the photosensitive bodies 31 of the respective developing cartridges to form electrostatic latent images on the surfaces of the photosensitive bodies 31. The development rollers 33 of the respective developing cartridges supply toner to the photosensitive bodies 31, so that the electrostatic latent images on the respective photosensitive bodies 31 are developed into toner images of yellow, magenta, cyan and black.

The paper A, which is picked up by the pickup roller 23, is attached to the transfer belt 35, and is conveyed at the same speed as the traveling speed of the transfer belt 35. At this time, voltage having a polarity opposite to the toner adhered to the respective photosensitive bodies 31 is applied to the respective transfer rollers 38, and the toner images on the photosensitive bodies 31 are transferred onto the paper A. Accordingly, the toner images of yellow, magenta, cyan and black formed on the respective photosensitive bodies 31 are overlappingly transferred sequentially onto the conveyed paper A. As a result, a color toner image is formed on the paper A.

The toner image transferred onto the paper A is fused thereon while passing through the fusing device 40. The paper A having passed through the fusing device 40 passes by the sensor 101 as illustrated in FIG. 2, and then is conveyed onto the guide member 210 provided in the rear portion of the housing 10 by the conveying roller 111.

Figure 4:
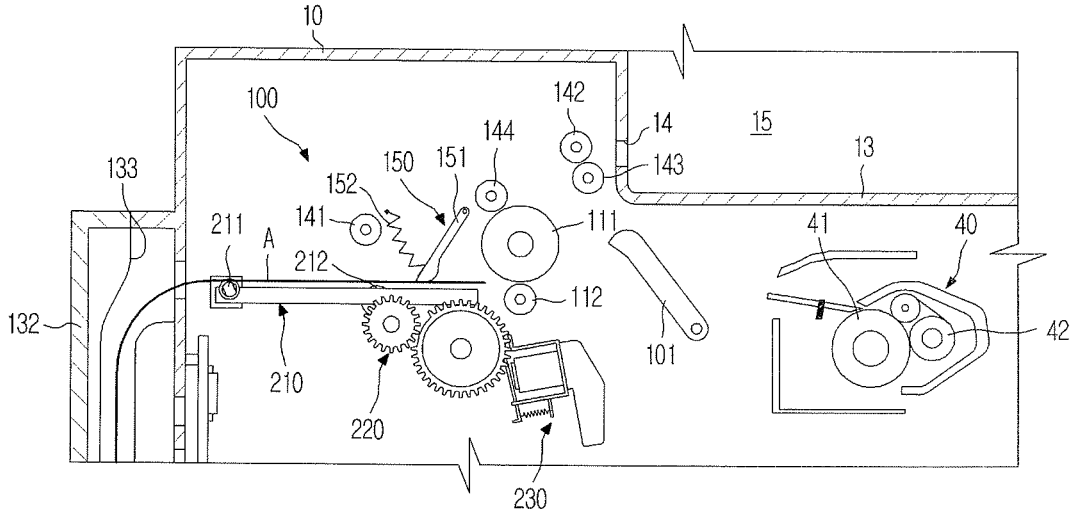
FIGS. 4 to 6 are views illustrating operations of an image forming apparatus according to an exemplary embodiment of the present general inventive concept.

The paper A conveyed onto the guide member 210 moves to the rear of the housing 10 until the rear end of the paper passes entirely through the conveying roller 111, as illustrated in FIG. 4. The front end of the paper A moving backward comes into contact with the guide rib 133, and the front end moves downward. Accordingly, the paper A moves downward in the receiving space 131. At this time, since the paper A is pressed by the fixing member 151 of the paper fixing part 150, even when the rear end of the paper A passes through the conveying roller 111, the paper A is prevented from falling into the receiving space 131 by its own weight.

When the sensor 101 senses that the paper A is conveyed to the discharge reverse unit 120, after a predetermined time to permit the rear end of the paper A to pass through the conveying roller 111, the actuator 232 is operated to move the locking member 231 to the releasing position. Thereby, the second gear 223 is initially rotated by the frictional force by the rotation of the first gear 222, and then the first gear 222 and the second gear 223 are tooth-engaged with each other.

Accordingly, the second gear 223 is rotated, and the cam parts 225 are interlockingly rotated with the second gear 223.

While the second gear 223 is rotated once, the roller parts 213 of the guide member 210 roll on the outer surfaces of the cam parts 225 by the rotation of the cam parts 225. As a result, the guide member 210 is lifted up and down.

Figure 5:
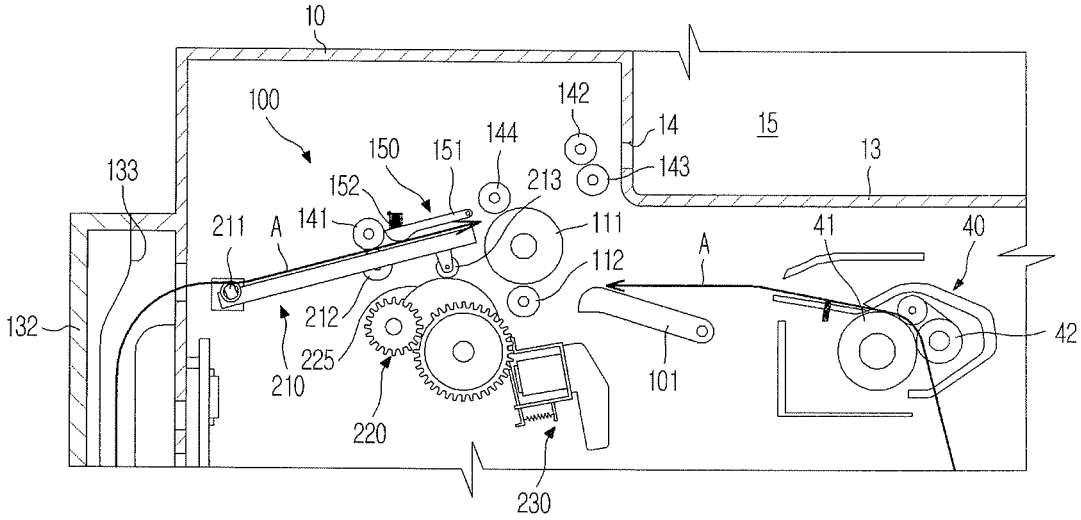
Figure 6:
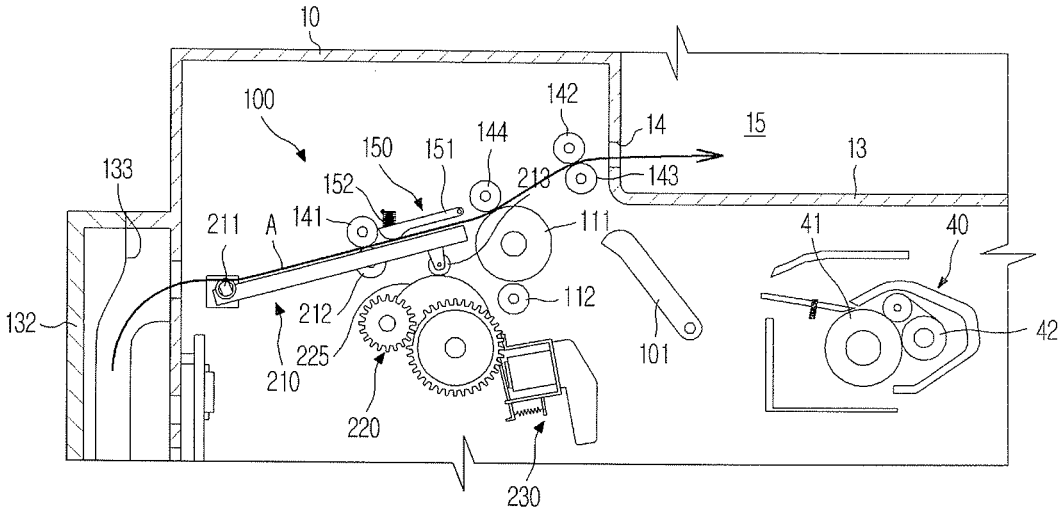

When the guide member 210 is lifted up, as illustrated in FIGS. 5 and 6, the guide roller 212 of the guide member 210 comes into contact with the first discharge roller 141, and the paper A on the guide member 210 passes between the conveying roller 111 and the first discharge idle roller 144 and moves toward the discharge port 14.

When the guide member 210 is lifted down after one rotation of the second gear 223, the actuator 232 is turned off. Thereby, the locking member 231 is moved to the region between the teeth of the second gear 223, and restrains the rotation of the second gear 223. At this time, since the teeth of the first gear 222 are in contact with the idling region 223*a* of the second gear 223, the rotational force of the first gear 222 is not transmitted to the second gear 223, and the first gear 222 is kept in an idling state.

After the guide member 210 is lifted down, the following sheet of paper A is conveyed onto the guide member 210, and the above-described operation is repeated.

As described above, immediately after the preceding sheet of paper A is conveyed to the discharge unit 140 from the guide member 210, which has been lifted up, the guide member 210 is lifted down so that the following sheet of paper A can be conveyed onto the guide member 210. Accordingly, simultaneously with moving the preceding sheet of paper A by the discharge unit 140, the following sheet of paper A can be conveyed onto the guide member 210. As a result, the interval between the paper sheets to be discharged is shortened, and thus time taken to discharge the paper sheets can be decreased.

In the above description, the present general inventive concept has been explained with reference to the electrophotographic type color multifunction printer. However, the features of the present general inventive concept can also be applied to other image forming apparatuses, such as ink-jet printers, copying machines, fax machines, etc.

Figure 9:
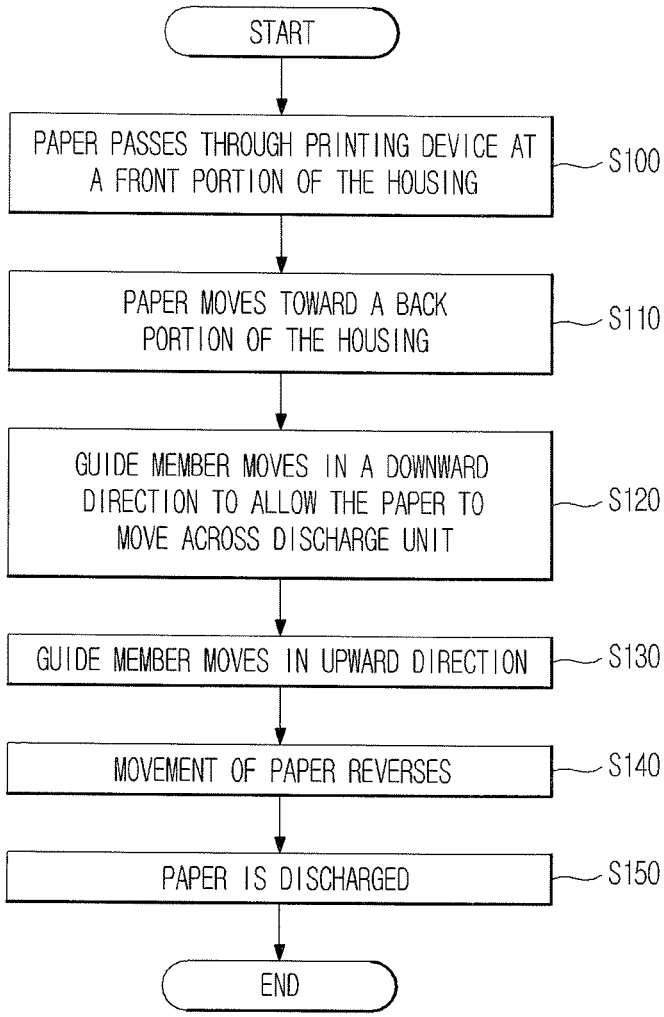
FIG. 9 is a flowchart illustrating a method of moving a printing medium through a housing of an image forming apparatus according to an embodiment of the present general inventive concept.

FIG. 9 is a flowchart illustrating a method of moving a printing medium (i.e., the paper A) through a housing 10 of an image forming apparatus according to an embodiment of the present general inventive concept. As illustrated in FIG. 9 (and referring to FIGS. 1 and 2), the paper A passes through the printing device 30 at a front portion of the housing 10 in order to print an image of a first side thereof in operation S100. In operation S110, the paper A moves toward a back portion of the housing 10. In operation S120, the guide member 210 is moved in a downward direction to allow the paper A to move across the discharge reverse unit 120. While the paperA is moving across the discharge reverse unit 120, the paper fixing part 150 prevents the paperA from moving away from the discharge reverse unit 120. In operation S130, the guide member 210 is moved upward. Then in operation S140, the movement of the paper A is reversed in a direction toward the front portion of the housing 10 in order to be discharged out the image forming apparatus. Finally in operation S150, the paper A is discharged out the image forming apparatus.

As apparent from the above description, the image forming apparatus according to the present general inventive concept can prevent the paper on the guide member from falling away from the guide member due to its own weight by use of the paper fixing part.

Further, since the discharge unit and the discharge reverse unit can be driven simultaneously by use of the single motor, manufacturing costs can be demonstrated.

Further, the discharge reverse unit can be simply constituted in such a manner that the guide member is lifted up and down by use of the gear part and the cam part.

Still further, since the paper receiving part, i.e., the space allowing the movement of the front end of the paper before the moving direction of the paper is reversed, is formed small, the overall size of the image forming apparatus can be compact.

Although a few embodiments of the present general inventive concept have been shown and described, it would be appreciated by those skilled in the art that changes may be made in this embodiment without departing from the principles and spirit of the general inventive concept, the scope of which is defined in the appended claims and their equivalents.

What is claimed is:

1. An image forming apparatus, comprising:

a housing having a discharge port facing towards a front cover of the housing;

a printing device mounted inside the housing to perform a printing operation on a print medium, the printing device including a plurality of developing cartridges mounted inside the housing and a transfer belt arranged between the plurality of developing cartridges and the front cover;

a conveying unit to convey the print medium passing through the printing device towards a rear surface of the housing; and a discharge reverse unit to direct the print medium passing through the conveying unit towards the front cover of the housing in a reverse direction, wherein the discharge reverse unit includes a guide member rotatably mounted in the housing such that the print medium directed towards the front cover of the housing is guided upward towards the discharge port of the housing by the guide member, and a lifting part to contact and lift the guide member up and down at a first end portion thereof while the guide member pivots upon a fulcrum point disposed at a second end portion thereof.

2. The image forming apparatus of claim 1, wherein the discharge reverse unit includes a paper fixing part to prevent the paper on the guide member from moving away from the guide member.

3. The image forming apparatus of claim 2, wherein the discharge unit includes a plurality of discharge rollers, and the guide member further includes a guide roller to convey the paper, whereby when the guide member is lifted up, the guide roller comes into contact with any one of the discharge rollers to move the paper toward the discharge port.

4. The image forming apparatus of claim 2, wherein the paper fixing part presses the paper to prevent the paper on the guide member from moving away from the guide member.

5. The image forming apparatus of claim 1, wherein the lifting part further comprises:

a driving motor, a gear part connected to the driving motor, and a cam part to lift the guide member up and down according to rotation of the gear part.

6. The image forming apparatus of claim 5, wherein the discharge unit includes a plurality of discharge rollers, the discharge rollers being driven by the driving motor.

7. The image forming apparatus of claim 5, wherein:

the gear part includes a first gear to transmit a driving force of the driving motor, and a second gear receiving a rotational force of the first gear; the first gear is kept in an idling state in a predetermined region of the second gear; and the cam part is interlockingly rotated with rotation of the second gear.

8. The image forming apparatus of claim 7, wherein the discharge reverse unit further includes an intermittence unit to intermit rotation of the second gear.

9. The image forming apparatus of claim 8, wherein the intermittence unit includes a locking member to intermit rotation of the second gear, and an actuator to drive the locking member.

10. The image forming apparatus of claim 5, wherein the guide member further includes a roller part corresponding to the cam part to smoothly lift the guide member up and down.

11. The image forming apparatus of claim 1, further comprising:

a sensor provided in a downstream position from the printing unit to sense a moving position of the paper.

12. The image forming apparatus of claim 1, further comprising:

a paper receiving part to receive a front end of the paper positioned in the discharge reverse unit.

13. The image forming apparatus of claim 12, wherein the paper receiving part changes the moving direction of the paper to a down direction.

14. An image forming apparatus, comprising:

a housing;

a printing device to form an image on a printing medium;

a conveying unit to convey the printing medium with the image and having a roller to rotate in a direction;

a discharge reverse unit to receive the printing medium from a first portion of the roller of the conveying unit, and to direct the printing medium upward toward a second portion of the roller, the discharge reverse unit comprising:

a guide member movable up and down at a first end portion, a lifting member to contact the first end portion to perform the up and down movement of the first end portion, and a shaft disposed at a second end portion to function as a fulcrum to allow the first end portion to move up and down; and a discharge unit to discharge the printing medium with the second portion of the roller.

15. The image forming apparatus of claim 14, wherein the guide member is extended from the shaft toward the roller.

16. The image forming apparatus of claim 15, wherein the first end portion moves between the first portion of the roller and the second portion of the roller.

17. The image forming apparatus of claim 15, wherein:

a first path is formed with respect to the first portion;

a second path is formed with respect to the second portion; and the first path and the second path are formed to be opposite with respect to a line connecting the shaft and a center of the roller.

18. The image forming apparatus of claim 15, wherein the discharge reverse unit comprises:

a cam part to selectively rotate according to a moving direction of the printing medium, such that the cam part controls the movement of the guide member between the first portion of the roller and the second portion of the roller.

19. The image forming apparatus of claim 14, wherein the housing includes a discharge port located at a front portion thereof.

20. An image forming apparatus, comprising:

a housing including a discharge port located at a front portion thereof;

a printing device mounted at the front portion of the housing to form an image onto a printing medium;

a conveying roller to receive the printing medium from the printing device;

a paper receiving part to receive a front end of the printing medium in an opening thereof after passing through a first portion of the conveying roller; and a discharge reverse unit to reverse a movement of the printing medium toward the discharge port to discharge the printing medium by passing the printing medium upward through a second portion of the conveying roller, the discharge reverse unit comprising:

a cam part to selectively rotate according to a moving direction of the printing medium, and a guide member to move up and down at a first end according to the rotation of the cam part that contacts the first end while pivoting at a fulcrum point at a second end.

* * * * *